US010488016B2

(12) United States Patent
Xie et al.

(10) Patent No.: US 10,488,016 B2
(45) Date of Patent: Nov. 26, 2019

(54) LIGHT-EMITTING DIODE (LED) LIGHTING DEVICE

(71) Applicant: OPPLE LIGHTING CO., LTD., Shanghai (CN)

(72) Inventors: Jianmin Xie, Shanghai (CN); Xiufeng Shi, Shanghai (CN); Chaobo Liu, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 138 days.

(21) Appl. No.: 15/369,479

(22) Filed: Dec. 5, 2016

(65) Prior Publication Data

US 2017/0082265 A1 Mar. 23, 2017

Related U.S. Application Data

(63) Continuation of application No. PCT/CN2015/080800, filed on Jun. 4, 2015.

(30) Foreign Application Priority Data

Jun. 6, 2014 (CN) ..... 2014 1 0248533
Jun. 6, 2014 (CN) ..... 2014 2 0298896 U

(51) Int. Cl.
*F21V 7/00* (2006.01)
*F21V 3/00* (2015.01)
(Continued)

(52) U.S. Cl.
CPC ..... *F21V 7/00* (2013.01); *F21V 3/00* (2013.01); *F21V 17/12* (2013.01); *F21V 17/164* (2013.01);
(Continued)

(58) Field of Classification Search
CPC . F21V 7/00; F21V 17/10; F21V 17/12; F21V 17/16; F21S 8/00
See application file for complete search history.

(56) References Cited

U.S. PATENT DOCUMENTS 3,560,732 A * 2/1971 Green ..... F21S 8/02 362/451
9,188,324 B2 * 11/2015 Jelinek ..... F21V 31/005
(Continued)

FOREIGN PATENT DOCUMENTS

CN 202868399 U 4/2013
CN 203131508 U 8/2013
(Continued)

OTHER PUBLICATIONS

Machine Translation of CN 203348956 U.*
(Continued)

*Primary Examiner* — Jong-Suk (James) Lee
*Assistant Examiner* — Christopher E Dunay
(74) *Attorney, Agent, or Firm* — Arch & Lake LLP

(57) ABSTRACT

An LED lighting device is provided. The LED lighting device includes at least one light source, a base board, a reflector, a shell, a drive module and a mounting structure. The at least one light source is arranged on the base board. The base board and the reflector are contained in the shell. The drive module is assembled to the mounting structure. The LED lighting device includes connector connecting the mounting structure with the reflector. The base board and the shell are sandwiched between the reflector and the mounting structure.

15 Claims, 7 Drawing Sheets

(51) Int. Cl.

| | |
|---|---|
| ***F21V 17/12*** | (2006.01) |
| ***F21V 17/16*** | (2006.01) |
| ***F21V 23/00*** | (2015.01) |
| *F21Y 115/10* | (2016.01) |

(52) U.S. Cl.
CPC ..... *F21V 23/001* (2013.01); *F21V 23/005* (2013.01); *F21Y 2115/10* (2016.08)

(56) References Cited

U.S. PATENT DOCUMENTS

| | | | | |
|---|---|---|---|---|
| 9,835,313 | B2 * | 12/2017 | Feng | F21V 13/10 |
| 9,920,894 | B2 * | 3/2018 | Briggs | F21S 8/026 |
| 2006/0126354 | A1 * | 6/2006 | Fu | F21K 9/00 362/545 |
| 2013/0051046 | A1 * | 2/2013 | Yeh | B60Q 1/0052 362/487 |
| 2013/0250586 | A1 * | 9/2013 | Sasaki | F21V 29/20 362/373 |
| 2014/0268797 | A1 * | 9/2014 | Gabrius | F21V 17/002 362/294 |
| 2015/0085495 | A1 * | 3/2015 | Seki | F21S 8/02 362/310 |
| 2016/0061421 | A1 * | 3/2016 | Winters | F21V 23/00 362/308 |
| 2018/0058676 | A1 * | 3/2018 | Huang | F21V 23/005 |

FOREIGN PATENT DOCUMENTS

| | | | |
|---|---|---|---|
| CN | 203348956 | U | 12/2013 |
| CN | 203893008 | U | 10/2014 |
| WO | 2015185007 | A1 | 12/2015 |

OTHER PUBLICATIONS

International Search Report issued in corresponding PCT Application No. PCT/CN2015/080800, dated Sep. 10, 2015, 4 pages.
Written Opinion issued in corresponding PCT Application No. PCT/CN2015/080800, dated Apr. 6, 2015, 5 pages.

* cited by examiner

LIGHT-EMITTING DIODE (LED) LIGHTING DEVICE

CROSS-REFERENCE TO RELATED APPLICATIONS

The present application is a continuation of PCT Application PCT/CN2015/080800 filed on Jun. 4, 2015, which claims priority to Chinese patent applications No. 201420298896.1 and 201410248533.1 filed concurrently on Jun. 6, 2014, both of which are incorporated herein by reference in their entireties.

TECHNICAL FIELD

The present disclosure relates to a lighting device, especially to a light-emitting diode (LED) lighting device.

BACKGROUND

At present, a down lamp usually comprises at least one LED, a base board, a shell, a reflector and drive module. The shell is of tube shape and contains the at least one LED, the base board, and the reflector therein. The at least one LED is arranged on the base board, while the base board is installed to the inner surface of the bottom wall of the shell via screws. Since the tube-shape shell has a certain depth, it is restricted to install the base board to the inner surface of the bottom wall of the shell which is not convenient. Moreover, the reflector and the base board are connected to the shell individually which makes the structure of the down lamp more complicated, and more time consuming to assemble such a down lamp.

Hence, it is desirable to provide an improved LED lighting device to overcome the above shortcomings.

SUMMARY

It is an object of the present disclosure to provide an LED lighting device.

According to a first aspect of the disclosure, the LED lighting device includes at least one light source, a base board, a reflector, a shell, a drive module and a mounting structure. The at least one light source is arranged on the base board, and the base board and the reflector are contained in the shell. The drive module is assembled to the mounting structure. The LED lighting device includes connector connecting the mounting structure with the reflector. The base board and the shell are sandwiched between the reflector and the mounting structure.

According to a second aspect of the disclosure, a lighting device includes: at least one light-emitting diode (LED) disposed on a base board; a reflector at least partially surrounding the at least one LED; a shell at least partially enclosing the base board and the reflector; a drive module providing power to the at least one LED; a mounting structure assembled to the drive module; and a connector that attaches the mounting structure to the reflector. The base board and the shell are sandwiched between the reflector and the mounting structure.

According to a third aspect of the disclosure, a lighting device includes: at least one light-emitting diode (LED) disposed on a base board; a reflector at least partially surrounding the at least one LED; an outer case at least partially enclosing the base board and the reflector; a mounting structure including a main body and a side edge extending substantially perpendicularly to an outer edge of the main body; and a connector that attaches the mounting structure to the reflector. The base board and the outer case are sandwiched between the reflector and the mounting structure.

It should be understood that both the foregoing general description and the following detailed description are exemplary only and are not restrictive of the disclosure.

BRIEF DESCRIPTION OF THE DRAWINGS

Some embodiments of the present disclosure are hereinafter described, by way of example only, with reference to the accompanying drawings, wherein.

Figure 1:
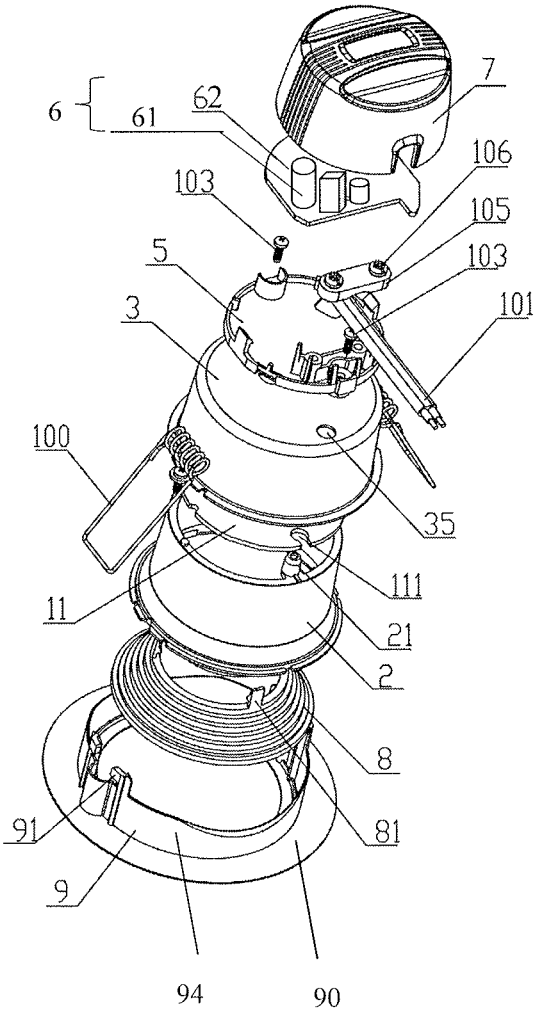
FIG. 1 is an exploded view of an LED lighting device in accordance with the present disclosure.
Figure 2:
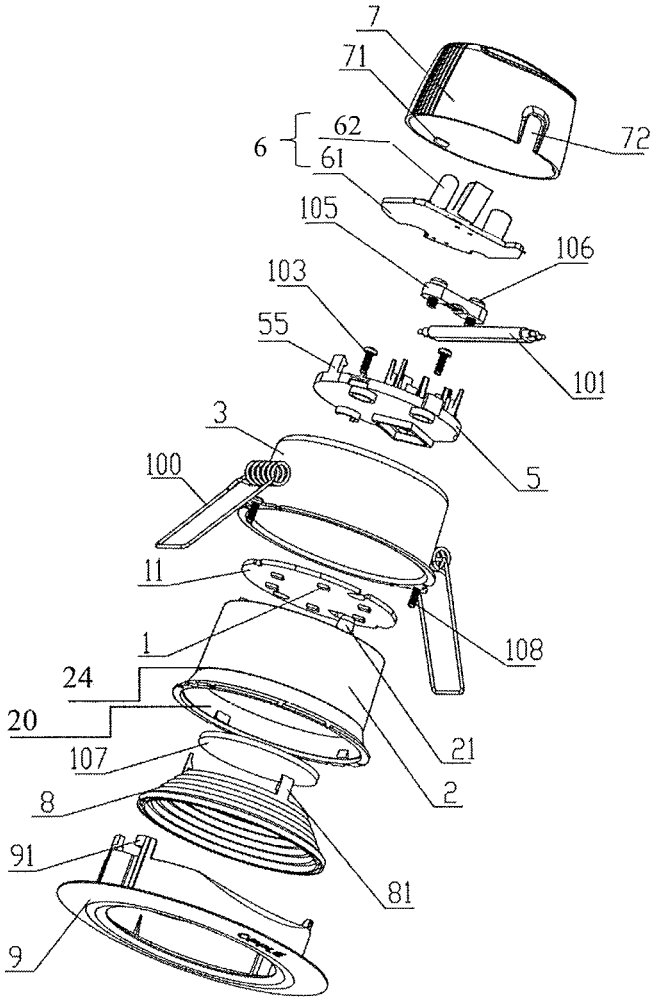
FIG. 2 is a view of the LED lighting device from a different view angle.
Figure 3:
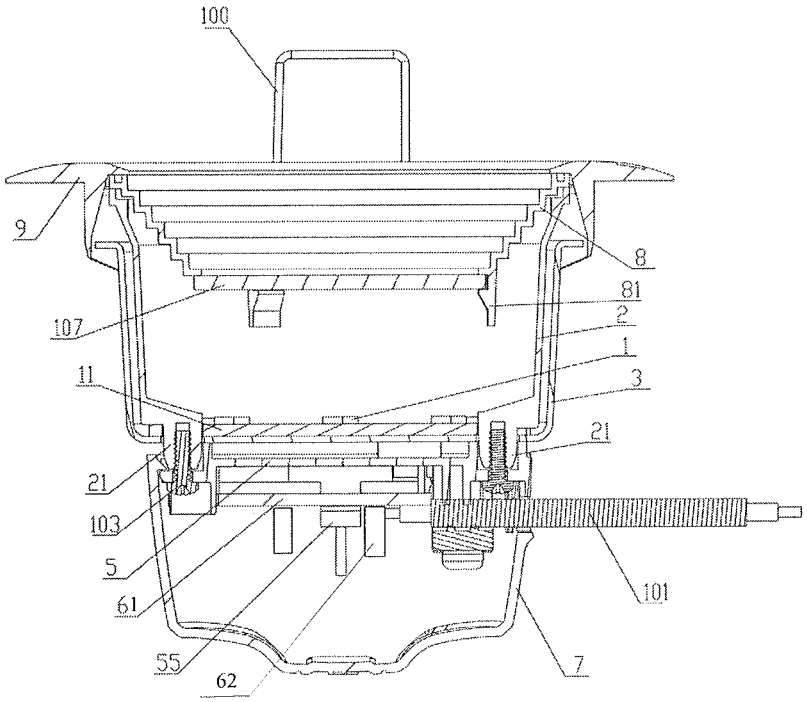
FIG. 3 is a cross-sectional view of the LED lighting device in accordance with the present disclosure.
Figure 4:
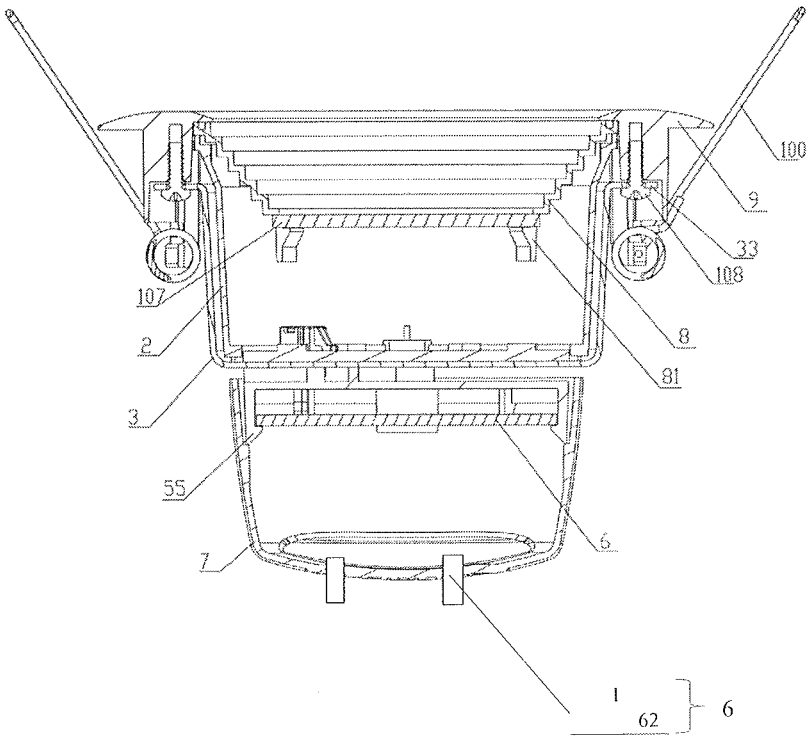
FIG. 4 is a view similar to FIG. 3, but from a different view angle.
Figure 5:
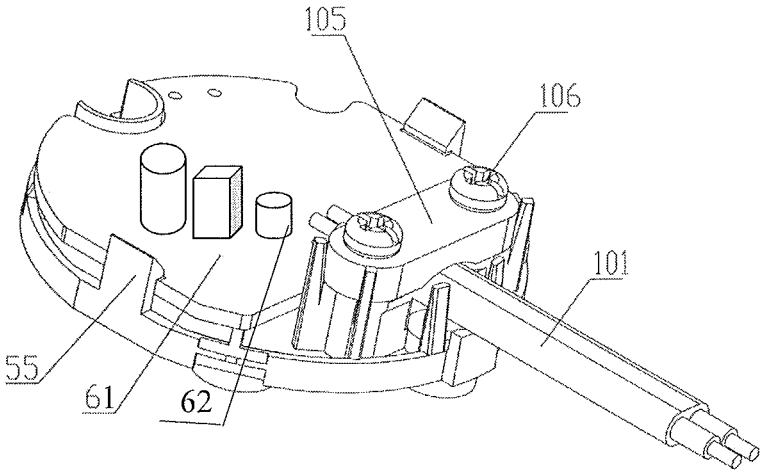
FIG. 5 is an assembled view of a drive module and a mounting structure.
Figure 6:
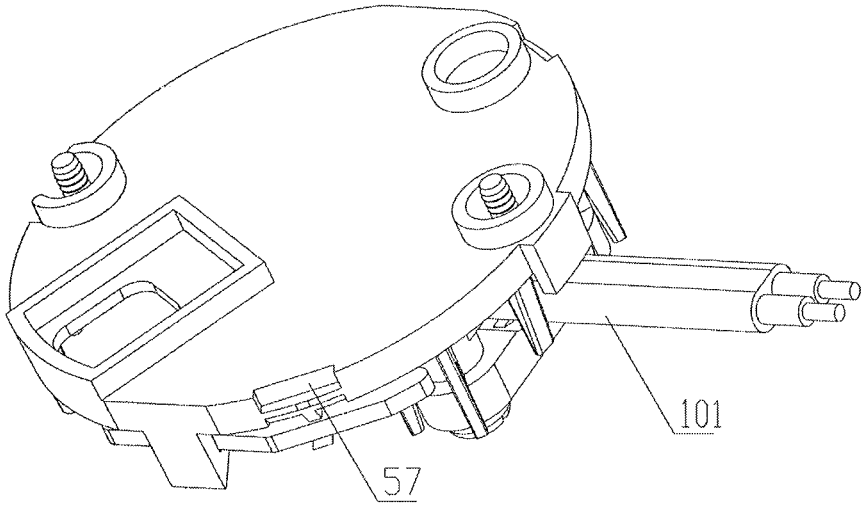
FIG. 6 is a view similar to FIG. 5 but viewed from a different view angle.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may include combined in any suitable manner.

In the disclosure, the connector includes at least a screw and a connecting section disposed on the reflector, and the screw screws with the connecting section to connect the reflector with the mounting structure.

The reflector may include a passage and a tube-type wall to form the passage, and the passage includes a lighting entrance and an opposite lighting exit, the connecting section is arranged near the lighting entrance. Here, the connecting section may include a screw post.

In the disclosure, the shell may include a bottom wall, a sidewall extending from the periphery of the bottom wall. The bottom wall defines a pair of through holes to accommodate the connecting section. For example, the pair of through holes allows the connecting section to pass through. The base board is supported by the inner surface of the bottom wall, while the base board defines a pair of cutouts corresponding to the connecting sections to accommodate the connecting section.

The mounting structure may include a flat main body, and the main body defines at least a through hole for the penetration of the at least one screw. Here, the mounting structure forms a plurality of support blocks and latching portions alternatively arranged on a side away from the shell, and the drive module includes a circuit board which is sandwiched between the support blocks and the latching portions.

In the disclosure, the lighting device may further include a cover assembled with the mounting structure to form a receiving space to receive the drive module. For example, the cover and the mounting structure latch with each other.

In the disclosure, the lighting device may further include an anti-dazzle element and a diffusion element to diffuse the light from the at least one light source, and the anti-dazzle element forms at least a pair of latches to support the diffusion element.

Here, the lighting device may further include a mounting ring and an anti-dazzle element, and the anti-dazzle element is sandwiched between the mounting ring and the reflector. The mounting ring and the shell are connected with each other via screws.

In the disclosure, the lighting device may further include a diffusion element, and the anti-dazzle element forms a plurality of latches extending away from the mounting ring, the diffusion element is put on the latches to get support.

An LED lighting device in accordance with the present disclosure will be introduced detailed with referring to FIGS. 1-11. The LED lighting device includes some light sources 1 which is preferably LED, a base board 11, a reflector 2, a shell 3, a drive module 6 and a mounting structure 5.

The drive module 6 includes a circuit board 61, and some electric components 62 arranged on the circuit board 61. The light sources 1 are arranged on the base board 11 and the base board 11 is designed to get power from the drive module 6 and then supplies power to the light sources 1. The base board 11 is preferably an AL board, a ceramic board or a PCB. The base board 11 and the reflector 2 are contained in the shell 3. The drive module 6 is assembled to the mounting structure 5. In detail, the mounting structure 5 is round and forms a plurality of hook-shape latching portions 55 and some support blocks 56, which are arranged alternatively along an outer edge of a surface of the mounting structure 5 opposite to the shell 3. Then, a circuit board 61 of the drive module 6 is supported by the support blocks 56 and pressed by the latching portions 55, please especially refer to FIG. 5. Thus, the drive module 6 is assembled to the mounting structure 5 without any additional connecting elements, such as screws and the device module is of lower cost.

The LED lighting device further includes connector, which connects the mounting structure 5 and the reflector 2 together. The base board 11 and the shell 3 are thus, sandwiched between the reflector 2 and the mounting structure 5. The connector includes at least one screw 103 and a connecting section 21 arranged on the reflector 2. The at least one screw 103 screws with the connecting section 21 to connect the mounting structure 5 with the reflector 2. In the present disclosure, there are two screws.

Figure 8:
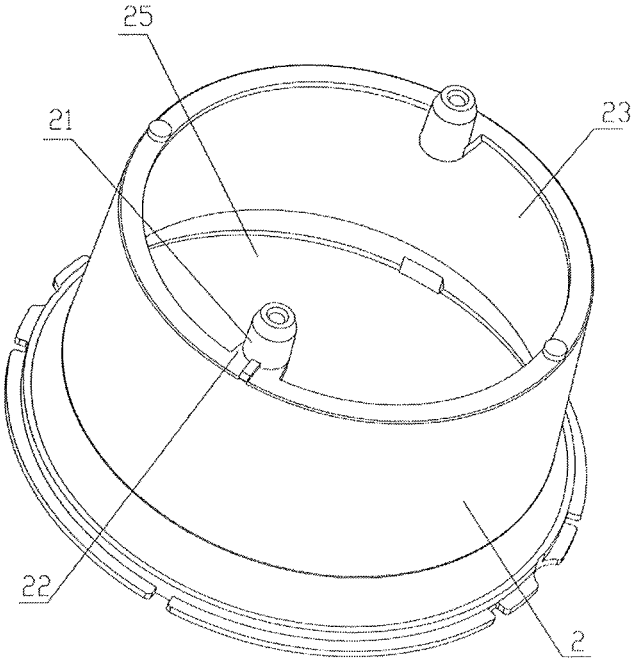
FIG. 8 is a perspective view of a reflector.

FIG. 8 is a perspective view of an example reflector 2. The reflector 2 includes a passage 20 and a tube-type wall 22 to form the passage 20. The passage 20 includes a lighting entrance 23 and an opposite lighting exit 25. The connecting section 21 is located near to the lighting entrance 23. In detail, the connecting section 21 is a screw post, and in the preferred embodiment of the present disclosure, there are two screw posts symmetrically arranged. The connecting sections 21 are integrated with the reflector 2 to reduce the amount of components of the LED lighting device of the present disclosure which makes the structure of the LED lighting device simpler, and more convenient to assemble.

Figure 9:
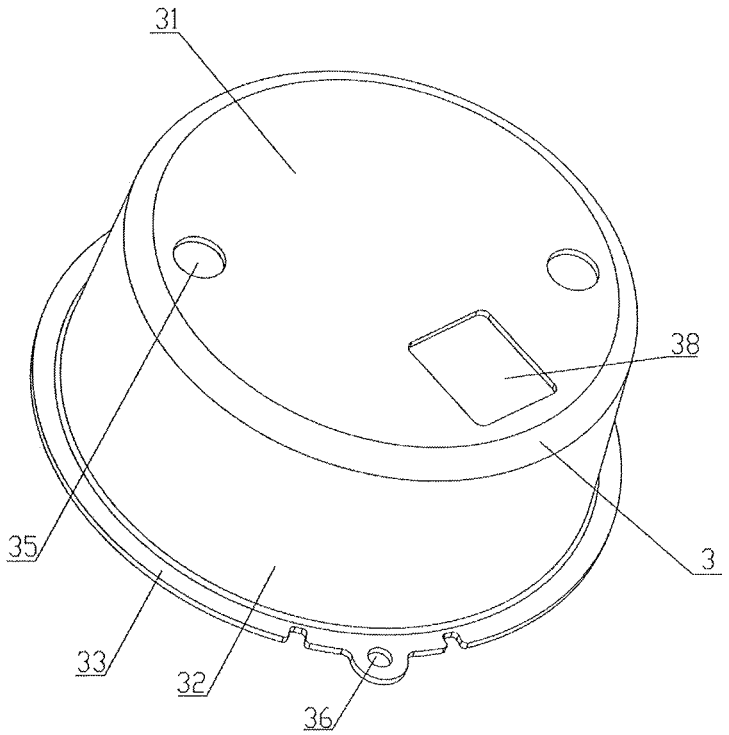
FIG. 9 is a perspective view of a shell.

FIG. 9 is a perspective view of a shell 3. The shell 3 may be an outer case that includes a bottom wall 31, a sidewall 32 extending from the periphery of the bottom wall 31, and a folded edge 33 extending substantially perpendicular to the sidewall 32. A pair of through holes 35 for the penetration of the connecting section 21 and a wire-passing passage 38 are defined in the bottom wall 31 and near to the periphery of the bottom wall 31. The through holes 35 are symmetrically arranged. A pair of holes 36 are defined in the folded edge 33. In assembly, the base board 11 is supported by the inner surface of the bottom wall 31, while the base board 11 defines a pair of cutouts 111 corresponding to the connecting sections 21 for the penetration of the connecting section 21.

Figure 7:
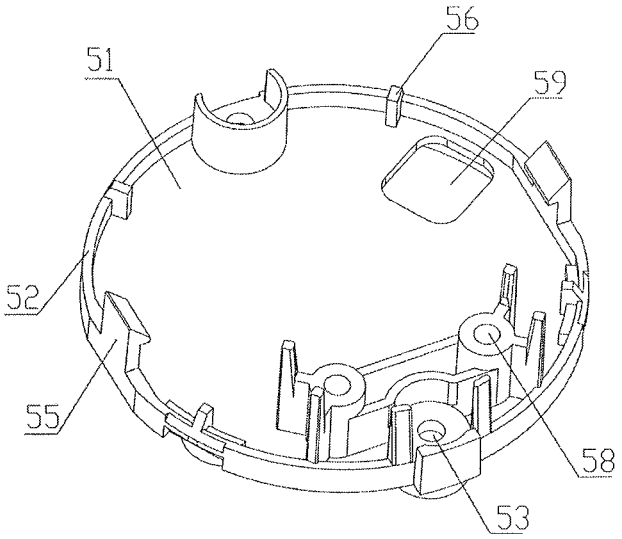
FIG. 7 is a perspective view of an example mounting structure.

FIG. 7 is a perspective view of an example mounting structure. The mounting structure 5 includes a main body 51 and a side edge 52 extending substantially perpendicularly to the outer edge of the main body 51. The latching portions 55 and the support blocks 56 are arranged to extend from the side edge 52. A pair of through holes 53 are symmetrically defined through the main body 51 and near to the periphery of the main body 51 for the penetration of the screws 103. In assembly, the through holes 53 of the mounting structure 5, the through holes 35 of the shell 3, and the cutouts 111 of the base board 11 are aligned with one another along an assembly direction, which is also the up-and-down direction of the LED lighting device. The connecting sections 21 penetrate the cutouts 111, the through holes 35 and then abut against one side of the mounting structure 5. The screws 103 penetrate the through holes 53 of the mounting structure 5 from the other side of the mounting structure to screw into the connecting sections 21 respectively to connect the reflector 2, the base board 11, the shell 3 and the mounting structure 5.

Figure 10:
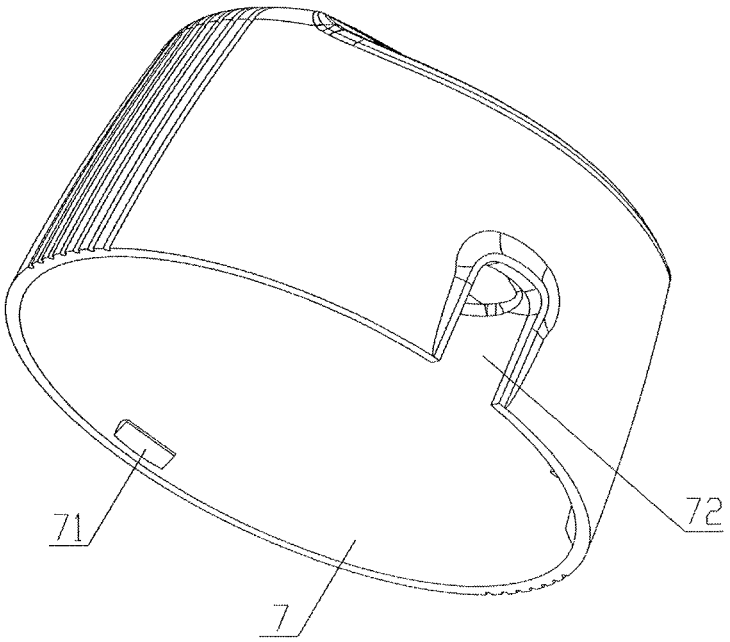
FIG. 10 is a perspective view of a cover.
Figure 11:
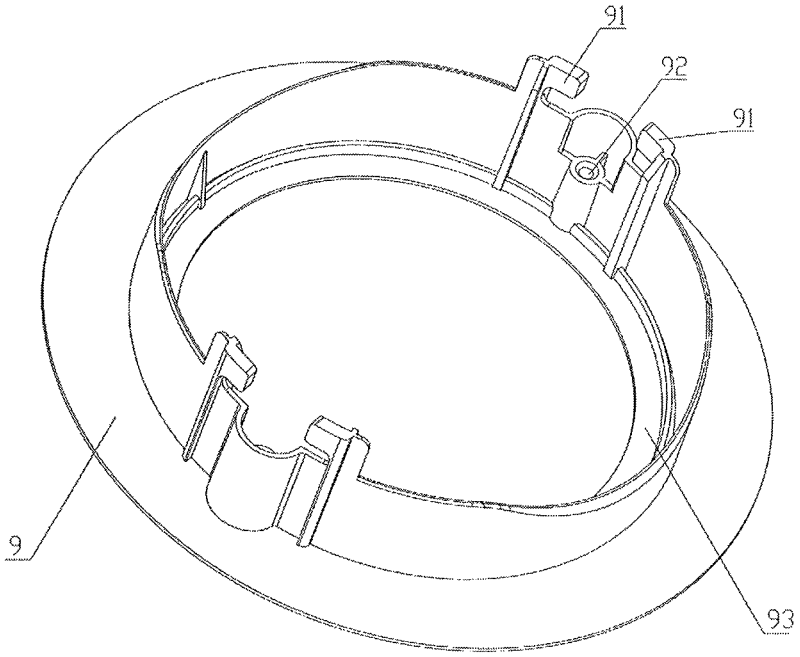
FIG. 11 is a perspective view of a mounting ring.

FIG. 10 is a perspective view of a cover 7 of the LED lighting device. In FIG. 10 the cover 7 combines with the mounting structure to form a receiving space. The drive module 6 is accommodated in the receiving space. The cover 7 and the mounting structure 5 latch with each other, in detail, the cover 7 forms a plurality of latches 71 on an inner wall thereof, while the mounting structure 5 defines a plurality of recesses 57 (in FIG. 6) corresponding to the latches 71 of the cover 7. Thus, the latches 71 latch with the recesses 57 to connect the cover 7 with the mounting structure 5. In an alternative embodiment, the latches could be arranged on the mounting structure 5, while the cover 7 defines the recesses. The cover 7 also includes a cutout 72 for the power wires 101 to pass through.

The LED lighting device further includes power wires 101 which connect the drive module 6 and an outer power source (not shown). The power wires 101 is pressed to be assembled to the mounting structure 5 by a wire-fasten element 105. A pair of screw holes 58 is defined in the main body 51 and a pair of screws 106 passes through the wire-fasten element 105 to fasten within the screw holes 58. Thus, the wire-fasten element 105 is assembled to the mounting structure 5. The cover 7 defines a cutout 72 to let the power wires 101 or other wires to pass through.

The LED lighting device further includes an anti-dazzle element 8 and a diffusion element 107. The anti-dazzle element 8 includes at least a pair of latches 81 extending from a side of the anti-dazzle element 8 near to the light sources 1. The diffusion element 107 and the anti-dazzle element 8 latch with each other via the latches 81. In an alternative embodiment, the latches could be arranged on the diffusion element 107.

The LED lighting device further includes a mounting ring 9 and a pair of jump springs 100. The mounting ring 9 includes a flat annular main section 90 extending along a horizontal direction and a round mounting section 94 extending vertically from an inner side of the main section 90. The mounting section 94 forms a pair of mounting ears 91 opposite to each other for installing the pair of jump springs 100. The mounting ring 9 defines a pair of screw holes 92 opposite to each other and each screw hole 92 is located near to a corresponding mounting ear 91. A screw 108 penetrates through the hole 36 of the folded edge 33 of the shell 3 and the screw hole 92 of the mounting ring 9 to fasten the shell 3 and the mounting ring 9. The mounting ring 9 forms a block section 93 which is of ring-shape and extends inwardly from the inner side of the main section 90. The anti-dazzle element 8 is sandwiched between the block section 93 and the lighting exit 25 of the reflector 2 to realize the installation of the anti-dazzle element 8.

In the preferred embodiment of the present disclosure, via connecting the mounting structure 5 and the reflector 2, the base board 11 and the shell 3 are sandwiched between the reflector 2 and the mounting structure 5. Only by a connector, the reflector 2, the base board 11, the shell 3 and the mounting structure 5 are mounted to one another. The structure of the LED lighting device is very simple, and easy to be realized. Thus, the material cost and the assembly cost is reduced.

It should be noted that the embodiments of the present disclosure are well implementable, and do not make limitations of any form to the present disclosure. Any changes or modifications that may be made by the technicians familiar with this field using the above-disclosed technical contents are equally effective embodiments. Any modifications or equivalent changes and polishes made on the above-described embodiments, which are not independent of the contents of the technical schemes of the present disclosure, and are in accordance with the technical essence of the present disclosure, are still covered in the scope of the technical schemes of the present disclosure.

What is claimed is:

1. A light-emitting diode (LED) lighting device, comprising:

at least one light source, a base board, a reflector, a shell, a drive module and a mounting structure, an anti-dazzle element and a diffusion element to diffuse the light from the at least one light source wherein the anti-dazzle element and the diffusion element have different shapes, the anti-dazzle element forms at least a pair of latches, the at least pair of latches extend from one side of the anti-dazzle element, and the anti-dazzle element latches onto the diffusion element situated in a path of light of the at least one light source, via the at least pair of latches; the at least one light source arranged on the base board, and the base board and the reflector contained in the shell, the drive module assembled to the mounting structure, and wherein the LED lighting device comprises connector connecting the mounting structure with the reflector, and the base board and the shell are sandwiched between the reflector and the mounting structure, wherein the connector comprises at least a screw and a screw post disposed on the reflector, and wherein the screw screws with the screw post to connect the reflector with the mounting structure.

2. The LED lighting device of claim 1, wherein the reflector comprises a passage and a tube-type wall to form the passage, and wherein the passage comprises a lighting entrance and an opposite lighting exit, the screw post is arranged near the lighting entrance.

3. The LED lighting device of claim 1, wherein the shell comprises a bottom wall, a sidewall extending from a periphery of the bottom wall, and wherein the bottom wall defines a pair of through holes for the penetration of the screw post, the base board is supported by an inner surface of the bottom wall, while the base board defines a pair of cutouts to accommodate one or more screw posts.

4. The LED lighting device of claim 1, wherein the mounting structure comprises a flat main body, and wherein the main body defines at least a through hole for the penetration of at least one screw.

5. The LED lighting device of claim 4, wherein the mounting structure comprises a plurality of support blocks and latching portions alternatively arranged on a side away from the shell, and wherein the drive module comprises a circuit board which is sandwiched between the support blocks and the latching portions.

6. The LED lighting device of claim 5, further comprising a cover assembled with the mounting structure to form a receiving space to receive the drive module.

7. The LED lighting device of claim 6, wherein the cover and the mounting structure latch with each other.

8. The LED lighting device of claim 1, further comprising the anti-dazzle element and the diffusion element to diffuse the light from the at least one light source, and wherein the anti-dazzle element forms the at least pair of latches to support the diffusion element.

9. The LED lighting device of claim 1, further comprising a mounting ring and the anti-dazzle element, and wherein the anti-dazzle element is sandwiched between the mounting ring and the reflector.

10. The LED lighting device of claim 9, wherein the mounting ring and the shell are connected with each other via screws.

11. The LED lighting device of claim 9, further comprising a diffusion element, and wherein the anti-dazzle element forms a plurality of latches extending away from the mounting ring, and wherein the diffusion element is put on the latches to get support.

12. A lighting device, comprising:

at least one light-emitting diode (LED) disposed on a base board;

a reflector at least partially surrounding the at least one LED;

a shell at least partially enclosing the base board and the reflector;

a drive module providing power to the at least one LED;

a mounting structure assembled to the drive module;

an anti-dazzle element and a diffusion element to diffuse the light from the at least one light source wherein the anti-dazzle element and the diffusion element have different shapes, the anti-dazzle element forms at least a pair of latches, the at least pair of latches extend from one side of the anti-dazzle element, and the anti-dazzle element latches onto the diffusion element situated in a path of light of the at least one light source, via the at least pair of latches; and a connector that attaches the mounting structure to the reflector, wherein the base board and the shell are sandwiched between the reflector and the mounting structure, wherein the connector comprises at least a screw and a screw post disposed on the reflector, and wherein the screw screws with the screw post to connect the reflector with the mounting structure.

13. The lighting device of claim 12, wherein the reflector comprises a passage and a tube-type wall to form the passage, and wherein the passage comprises a lighting entrance and an opposite lighting exit, the screw post is arranged near the lighting entrance.

14. The lighting device of claim 12, wherein the shell comprises a bottom wall, a sidewall extending from a periphery of the bottom wall, and wherein the bottom wall defines a pair of through holes for the penetration of the screw post, the base board is supported by an inner surface of the bottom wall, while the base board defines a pair of cutouts for one or more screw posts to pass through.

15. A lighting device, comprising:

at least one light-emitting diode (LED) disposed on a base board;

a reflector at least partially surrounding the at least one LED;

an outer case at least partially enclosing the base board and the reflector, a mounting structure including a main body and a side edge extending substantially perpendicularly to an outer edge of the main body;

an anti-dazzle element and a diffusion element to diffuse the light from the at least one light source wherein the anti-dazzle element and the diffusion element have different shapes, the anti-dazzle element forms at least a pair of latches, the at least pair of latches extend from one side of the anti-dazzle element, and the anti-dazzle element latches onto the diffusion element situated in a path of light of the at least one light source, via the at least pair of latches; and a connector that attaches the mounting structure to the reflector, wherein the base board and the outer case are sandwiched between the reflector and the mounting structure, wherein the connector comprises at least a screw and a screw post disposed on the reflector, and wherein the screw screws with the screw post to connect the reflector with the mounting structure.

* * * * *